US008360077B2

(12) United States Patent
Defenbaugh et al.

(10) Patent No.: US 8,360,077 B2
(45) Date of Patent: Jan. 29, 2013

(54) HEADBAND WITH PLIABLE ENDS

(75) Inventors: Michael Defenbaugh, Marietta, GA (US); Stan Chudzik, Alpharetta, GA (US); Allison Hardin, Smyrna, GA (US); Regina Hopper, Sylvania, OH (US)

(73) Assignee: Goody Products, Inc., Atlanta, GA (US)

( * ) Notice: Subject to any disclaimer, the term of this patent is extended or adjusted under 35 U.S.C. 154(b) by 639 days.

(21) Appl. No.: 11/833,438

(22) Filed: Aug. 3, 2007

(65) Prior Publication Data

US 2009/0032050 A1 Feb. 5, 2009

(51) Int. Cl.
*A45D 8/00* (2006.01)
*A45D 8/12* (2006.01)

(52) U.S. Cl. ..... 132/273; 132/275

(58) Field of Classification Search ..... 132/273–275, 132/246, 247, 253, 245; 2/171, 209.3; D28/41
See application file for complete search history.

(56) References Cited

U.S. PATENT DOCUMENTS

| | | | | |
|---|---|---|---|---|
| 2,032,898 | A | 3/1936 | Wilson | |
| 2,242,549 | A * | 5/1941 | Rose | 132/247 |
| 2,640,298 | A | 6/1953 | Mullen | |
| 2,868,214 | A * | 1/1959 | Levy | 132/273 |
| 3,031,681 | A * | 5/1962 | Hoeflich | 2/200.3 |
| 3,471,867 | A * | 10/1969 | Kirchhoff | 2/207 |
| 5,175,887 | A * | 1/1993 | Kim | 2/174 |
| 5,233,704 | A * | 8/1993 | Booher | 2/207 |
| 5,590,422 | A | 1/1997 | Henderson | 2/171 |
| 5,608,917 | A * | 3/1997 | Landis et al. | 2/418 |
| 5,692,243 | A | 12/1997 | Chang | 2/171 |
| 5,697,386 | A | 12/1997 | Chang | 132/273 |
| 5,937,872 | A * | 8/1999 | Wang | 132/273 |
| 5,987,647 | A * | 11/1999 | Ouellette | 2/171 |
| 6,076,532 | A | 6/2000 | Thomas et al. | 132/273 |
| 6,142,159 | A | 11/2000 | Lloyd | 132/278 |
| 6,263,512 | B1 * | 7/2001 | LeDonne | 2/171 |
| 6,295,992 | B1 | 10/2001 | Sapp | 132/200 |
| 6,470,896 | B1 | 10/2002 | Mensonides | |
| 6,681,778 | B1 | 1/2004 | Salisbury et al. | 132/277 |
| 6,981,507 | B2 | 1/2006 | Gabriele-Baumann | 132/275 |
| D536,132 | S | 1/2007 | Vergona | D28/40 |

(Continued)

FOREIGN PATENT DOCUMENTS

EP 699401 A1 * 3/1996

OTHER PUBLICATIONS

International Search Report and Written Opinion of the International Searching Authority for PCT/US2008/071682; date of mailing Nov. 3, 2008; 10 pages.

(Continued)

*Primary Examiner* — Robyn Doan
(74) *Attorney, Agent, or Firm* — Lempia Summerfield Katz LLC

(57) ABSTRACT

This invention provides a headband with pliable ends. More specifically, the headband with pliable ends has a curvilinear body integrally formed from an arcuate midsection and two pliable end sections. Each pliable end section extends from opposite ends of the midsection. The arcuate midsection structured and arranged to conform to a generalized top of head shape. The pliable end sections are each structured and arranged to be selectively deformable to conform to a user's side of head shape.

18 Claims, 6 Drawing Sheets

U.S. PATENT DOCUMENTS

| | | | | |
|---|---|---|---|---|
| 7,174,899 | B2 | 2/2007 | Lane | 132/273 |
| 7,174,901 | B2 | 2/2007 | Haar et al. | |
| 2002/0162564 | A1 | 11/2002 | Head et al. | 132/276 |
| 2004/0226574 | A1 | 11/2004 | Winn et al. | 132/277 |
| 2004/0231692 | A1 | 11/2004 | Shyu | 132/277 |
| 2006/0124149 | A1 | 6/2006 | Salisbury et al. | 132/277 |
| 2006/0225763 | A1 | 10/2006 | Lau | 132/277 |

OTHER PUBLICATIONS

English translation of Chinese Office Action issued in corresponding Chinese Application No. 200880101696; mailed Jul. 28, 2011.

Examination Report issued in corresponding Great Britain Application No. 1001347.2; mailed Sep. 15, 2011.

* cited by examiner

HEADBAND WITH PLIABLE ENDS

FIELD

This invention relates generally to the field of headbands and, in particular, to a headband with pliable ends.

BACKGROUND

Headbands, also referred to as hair bands, are widely used devices to retain the hair of a wearer towards the back of the head. Placed over the top of the head and extending down towards and behind the ears, common headbands are manufactured with biased tension so that they forcibly grip against the sides of the wearers head.

It is also well known that each human head is different—some being long, some narrow, some wide, some more circular, some more oval, etc. . . . Although hair bands may be made in a variety of different sizes, such as small, medium and large, it is economically unfeasible to make a multitude of different sizes.

Typically, the headband is formed in a general circular shape and size offerings of small, medium and large—if even offered —are simply different scales of the same generally circular design. As such, there is a general presumption that a headband may be usable, but it will not be an ideal fit.

In addition, as the ends are biased towards one another, the vast majority of headband wearers experience discomfort from the pressure. Often this discomfort will result in a painful headache. Various designs have been marketed wherein the ends have been elongated to warp farther around the head, but this has only moved the pressure points farther back. Others have attempted to provide wider pads at the end to distribute the pressure over a wider area. Such wider end headbands still provide too much pressure for some wearers and may be viewed as aesthetically displeasing.

Often the semi-rigid circular contour of the typical headband is also not easily worn or enjoyed by a user who is also wearing headphones. Even more frustrating is the use of eyeglasses, the arms of which frequently are trapped under the headband. This additional trapping of the eyeglass arms can and frequently does result in yet another set of uncomfortable pressure points for the user.

None of the known styles within the current market place have truly addressed the issue of head shape uniqueness and/or provided an effective way to bind to the wearer's head without providing pain inducing pressure. The mere fact that headband wearers grow up expecting a less than perfect fit and that the headband will be uncomfortable is certainly not an indication that headband consumers are happy with the current state of headband technology.

Hence, there is a need for a headband that overcomes one or more of the drawbacks identified above.

SUMMARY

This invention provides a headband with pliable ends.

In particular, and by way of example only, according to an embodiment, provided is a headband with pliable ends, comprising: a curvilinear body integrally formed from an arcuate midsection and two pliable end sections, each pliable end section extending from opposite ends of the arcuate midsection, the arcuate midsection structured and arranged to conform to a generalized top of head shape, the pliable end sections being structured and arranged to be selectively deformable to conform to a user's side of head shape In yet another embodiment, provided is a headband with pliable ends, comprising: a curvilinear body formed of a flexible material following a longitudinal centerline extending from a first pliable distal end through a resilient midsection to a second pliable distal end, the resilient midsection structured and arranged to conform to a generalized top of head shape, the pliable ends structured and arranged for a user to selectively deform to conform to the user's unique side of head shape.

Further still, in yet another embodiment, provided is a headband with pliable ends, comprising: a seamless curvilinear body structured and arranged to constrain a wearer's hair between a first distal end and a second distal end, the curvilinear body having a resilient arcuate midsection having a first end, a second end and a longitudinal axis there between, a first pliable metal element extending within the body from the midsection first end towards the first distal end; a second pliable metal element extending within the body from the midsection second end towards the second distal end; and the body formed of at least one flexible material.

And in addition, provided in yet another embodiment is a headband with pliable ends, comprising: a user deformable metal element having a first end, a midsection and a second end; a resilient first material disposed about the midsection of the metal element; a pliable second material disposed about the first end and the second end and seamlessly joined to the first material, the first and second materials enclosing the pliable metal element and providing a seamless curvilinear body structured and arranged to constrain a wearer's hair between a first distal end and a second distal end.

DETAILED DESCRIPTION

Before proceeding with the detailed description, it is to be appreciated that the present teaching is by way of example, not by limitation. The concepts herein are not limited to use or application with a specific headband with pliable ends. Thus, although the instrumentalities described herein are, for the convenience of explanation, shown and described with respect to exemplary embodiments, it will be appreciated that the principles herein may be equally applied in other types of headband with pliable ends and/or methods of using a headband with pliable ends.

Figure 1:
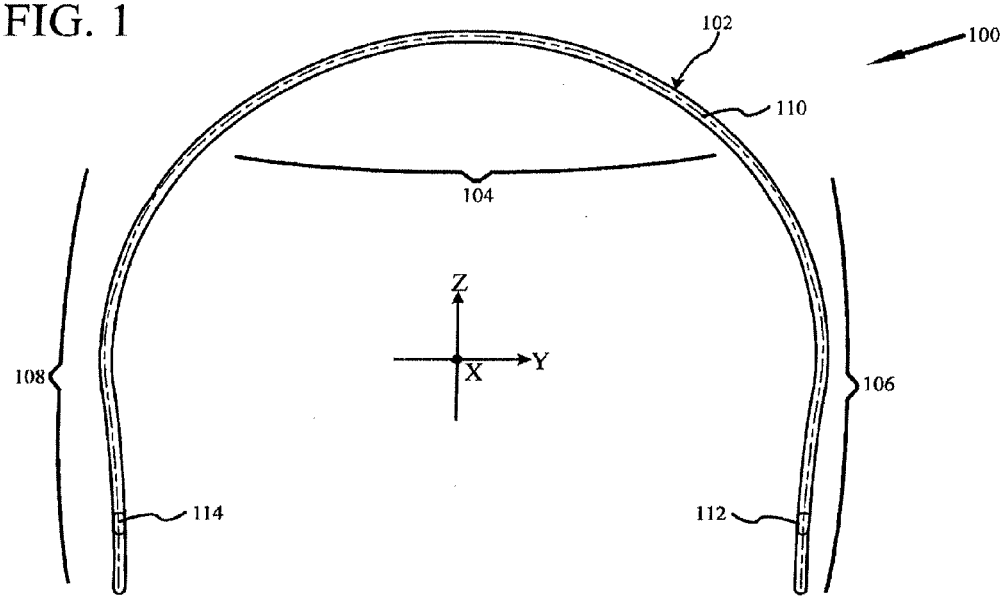
FIG. 1 is a plane view of a headband with pliable ends according to at least one embodiment.

Turning now to the figures, and more specifically FIG. 1, there is shown a headband 100 in accordance with at least one embodiment. More specifically it is a headband 100 with pliable ends as is further described below. To facilitate the description, the orientations are referenced to the coordinate system with three axes orthogonal to one another, as shown in FIG. 1. The axes intersect mutually at the origin of the coordinate system which is intended to be the center of the headband 100. The axes shown in all figures are offset from their actual locations for clarity of illustration. Moreover, FIG. 1 is a plane view of headband 100 against the ZY-plane.

As shown in FIG. 1, the headband 100 has a curvilinear body 102 formed from an arcuate midsection 104 and two pliable end sections 106 and 108. In at least one embodiment, the midsection 104 is a resilient midsection. The midsection 104 is structured and arranged to conform generally to a generalized top of head shape. As is further shown and described below, the pliable end sections 106 and 108 are structured and arranged to be selectively deformable so as to conform to a user's side of head shape.

Moreover, in at least one embodiment, the curvilinear body 102 is defined by a flexible material following a longitudinal centerline 100 from a first pliable distal end 102 through a resilient midsection 104 to a second pliable distal end 104. It is understood and appreciated that pliability is not limited to just the area proximate to first and second distal ends 102 and 104, but rather extends from each distal tip through the first end section 106 and second end section 108, respectively.

In at least one embodiment, the first pliable end section 106, the midsection 104 and the second pliable end section 108 each account for about one-third of the length of the curvilinear body 102. In at least one alternative embodiment, the first pliable end section 106 and the second pliable end section 108 each account for more than a third of the length of the curvilinear body 102. Moreover, in at least one embodiment, the curvilinear body 102 has a first length and the midsection 104 has a second length, the second length selected to be between about one-half and one-eighth of the first length.

Figure 2:
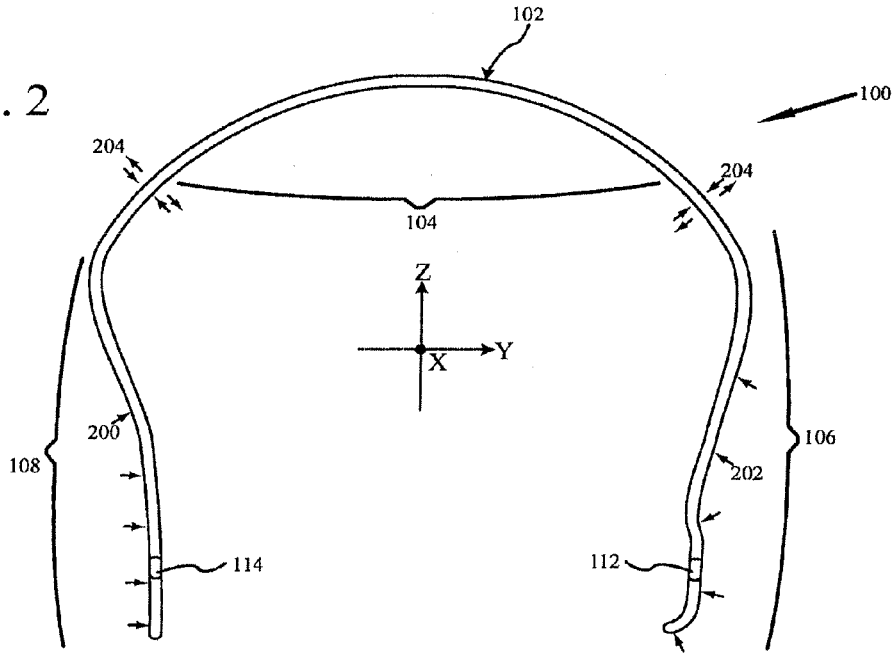
FIG. 2 is a plane view of the headband with pliable ends shown in FIG. 1, the pliable ends having been user deformed.

The pliability of the first end section 106 and second end section 108 is demonstrated in FIG. 2. The first pliable end section 106 has been deformed from the initial state shown in FIG. 1, by the application of force 200. The second pliable end section 108 has also been deformed from its initial state shown in FIG. 1, by the application of force 202, and also demonstrates that each pliable end is individually deformable. Upon the removal of forces 200 and 202, the first end section 106 and second end section 108 will remain in their user defined deformed state. It is understood and appreciated that first end section 106 and second end section 108 may be further deformed at a later date by a user. As noted above, in at least one embodiment the midsection 104 is preferably a resilient midsection 104 structured and arranged to act as a spring, and though it may be bent and is flexible, it is structured and arranged to return to its initial state as indicated by arrows 204.

Figure 3:
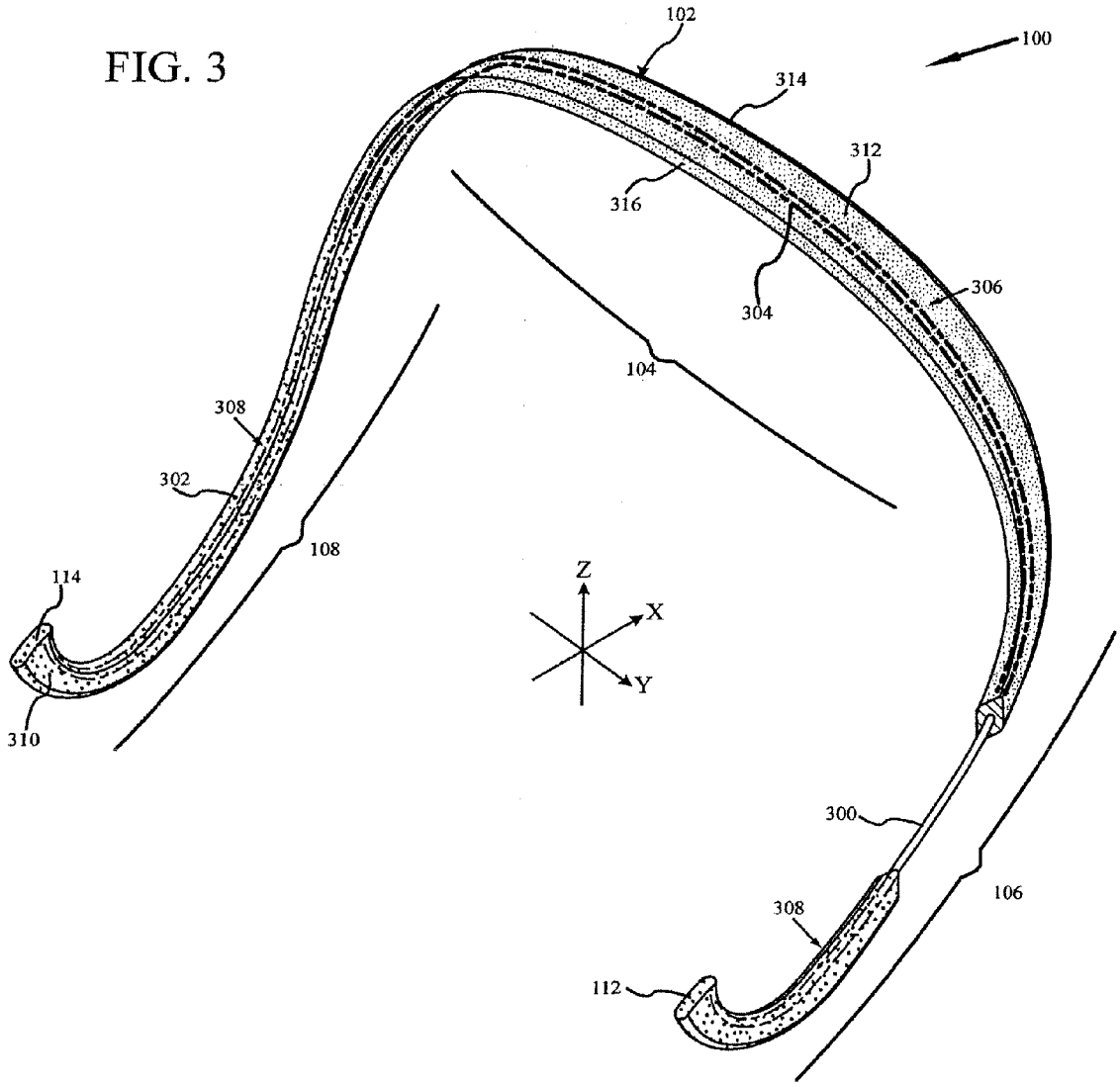
FIG. 3 is a perspective view of the headband shown in FIG. 1 with partial cutaway.

As is further shown in the perspective view of FIG. 3 with a partial cut away of the first pliable end section 106, a first deformable metal element 300 is disposed within the first pliable end section 106. The first deformable metal element 300 extends from the midsection 104 towards the first distal end 112. A second deformable metal element 302 is likewise disposed within the second pliable end section 108. As the second deformable end section 108 is not shown in cut-away relief, the second metal element 302 is indicated by heavy dotted lines 302. The second metal element 302 likewise extends from the midsection 104 towards the second distal end 114.

In at least one embodiment, the first deformable metal element 300 is a physically separate element from the second deformable metal element 302. In at least one alternative embodiment the first deformable metal element 300 and the second deformable metal element 302 are the first and second end portions of a continuous metal element 304 passing through the midsection 104.

Moreover, in at least one embodiment, the headband 100 includes an internal deformable metal core provided by metal element 304. This deformable metal element is over-molded with a flexible material. In at least one embodiment, the flexible material is selected from the group consisting of plastic, natural rubber, polyurethane, resin and/or combinations thereof.

In at least one embodiment, the flexible material may indeed have resilient properties, such that when applied to form the midsection having a first thickness the material provides a resilient property to the midsection 104. When applied to form the first pliable end 106 and the second pliable end 108 the thickness is reduced to a second thickness such that the resilient property of the material does not supersede the pliable nature of the deformable first and second metal elements 300, 302.

In at least one alternative embodiment, a resilient first material 306 is disposed about the midsection of the metal element 304. A pliable second material 308 is disposed about the first end section 106 and the second end section 108 and seamlessly joined to the first material. Moreover, the first material 306 is selected from the group consisting of plastic, natural rubber, polyurethane, resin and/or combinations thereof specifically selected for resilient characteristics. The second material 308 is likewise selected from the group consisting of plastic, natural rubber, polyurethane, resin and/or combinations thereof specifically selected for pliability characteristics. In at least one embodiment, the first material 306 and the second material 308 are the same material. In at least one alternative embodiment the first material 306 and the second material 308 are different materials.

With respect to the seamless joint or union between the first material 306 and the second material 308 as used herein seamless is understood and appreciated to be a joining of materials that is free of seams, joints or other structures that might unintentionally entrap and/or damage a user's hair. In at least one embodiment the second material 308 is over-molded upon the first material such that no external seam between the first and second materials is apparent.

As shown in FIG. 3, the first and second distal ends 112, 114 are shown to curve upwards in their initial state in at least one embodiment. In at least one alternative embodiment the first and second distal ends are not curved. However, as the distal ends 112, 114, and indeed the first and second end sections 106, 108 are pliable, it is understood and appreciated that regardless of initial configuration, in at least one embodiment a user may alter their orientation to his or her preferred alignment.

Figure 4:
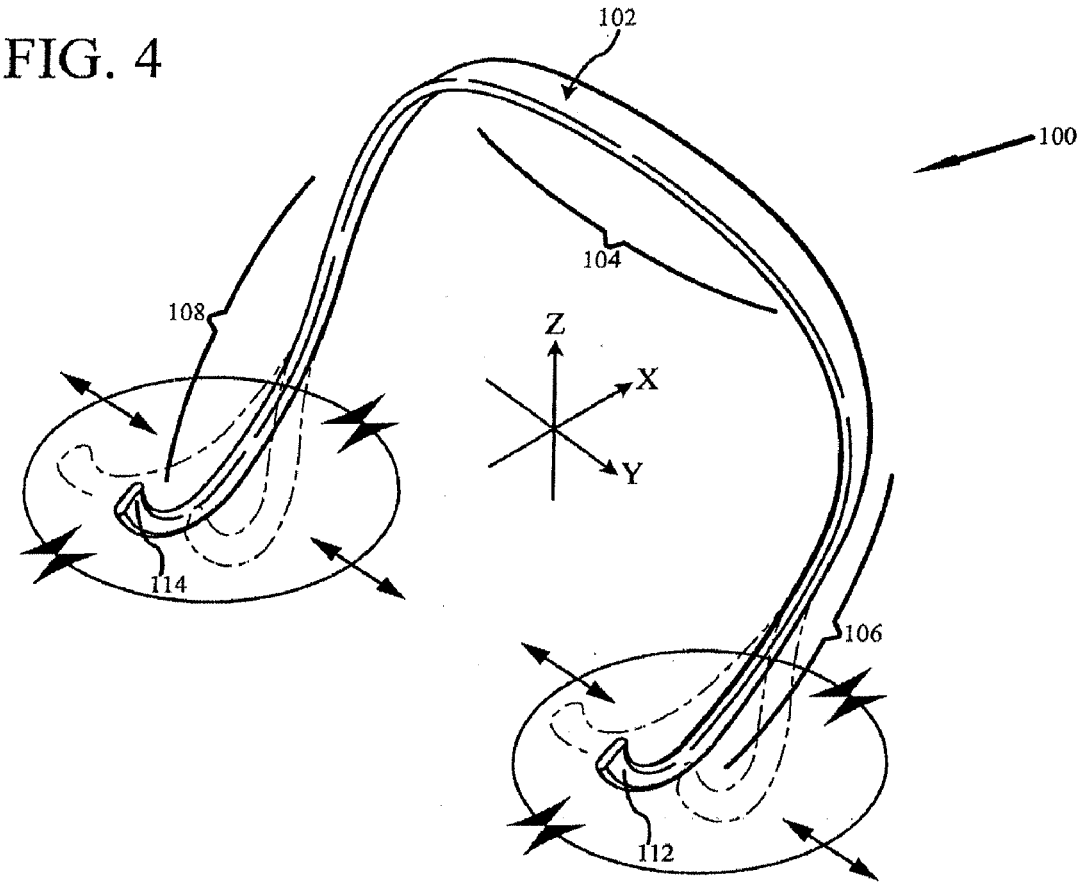
FIG. 4 is a perspective view of the headband shown in FIG. 1 illustrating the individual movement ranges of the first and second pliable end sections in accordance with at least one embodiment.
Figure 5:
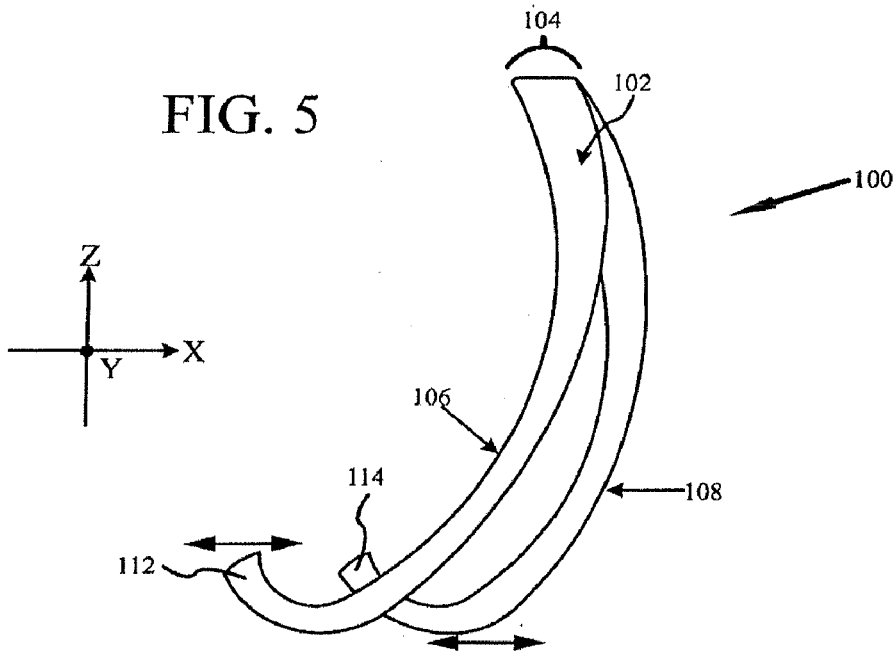
FIG. 5 is a side view of the headband shown in FIG. 4 further emphasizing the independent pliability of the first and second pliable end sections.

FIGS. 4 and 5 further illustrate the pliability of the first and second end portions, and more specifically the user adjustability they provide. As shown in FIG. 4, the first pliable end section 106 and the second pliable end section 108 are each capable of significant user selected adjustability from their initial manufactured state. As is further clarified in FIG. 5, showing a side view of the headband 100 against the ZX-plane the first and second pliable end sections 106, 108 are independently movable along the X-axis as well.

Figure 6:
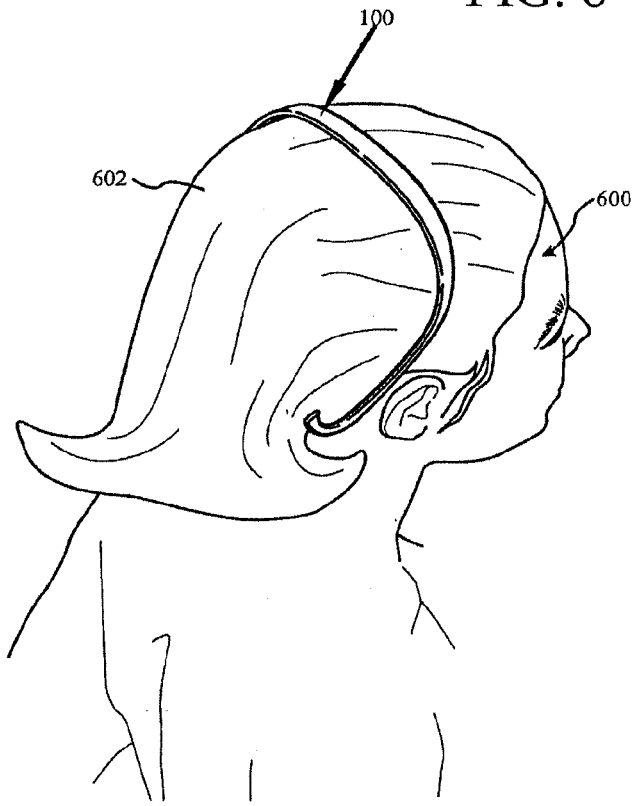
FIG. 6 is a perspective view of the headband in FIG. 1 in use by a user in accordance with at least one embodiment.

FIG. 6 illustrates the headband 100 in place upon a user's head 600 to temporarily contain and/or restrain the user's hair 602. Moreover, it is to be understood and appreciated that the deformability of the first and second pliable end sections 106, 108 is not limited to specific axis. With respect to the perspective view of FIG. 3, it is further appreciated that headband 100 has a first surface 310 and opposite thereto a second surface 312. In addition, headband 100 has a leading edge 314 and a trailing edge 316.

A user of headband 100 may advantageously deform first pliable end section 106 and second pliable end section 108 so as to customize the fit of headband 100 to his or her own head. In other words, the pliable first end section 106 and pliable second end section 108 permit user adjustment of the first surface 310 to maintain a contour to the user's head shape.

Figure 7:
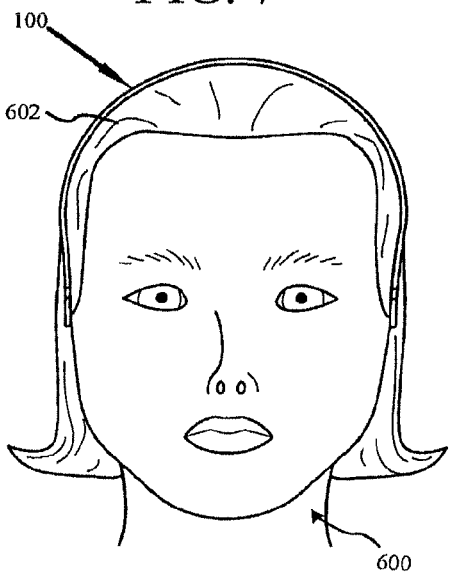
FIG. 7 is a front view of the headband in FIG. 1 in use upon the head of a user having a first head type, in accordance with at least one embodiment.
Figure 8:
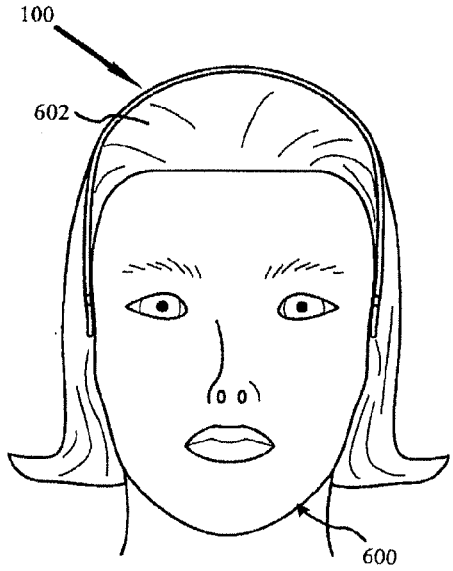
FIG. 8 is a front view of the headband in FIG. 1 in use upon the head of a user having a second head type, in accordance with at least one embodiment.

FIGS. 7 and 8 further demonstrate this by showing two alternative users with different head types, and for each, headband 100 has been customized to a personal fit. More specifically, the pliable ends permit the user to advantageously personalize their configuration so as to provide sufficient pressure to constrain his or her hair while advantageously providing insufficient pressure to cause discomfort.

Figure 9:
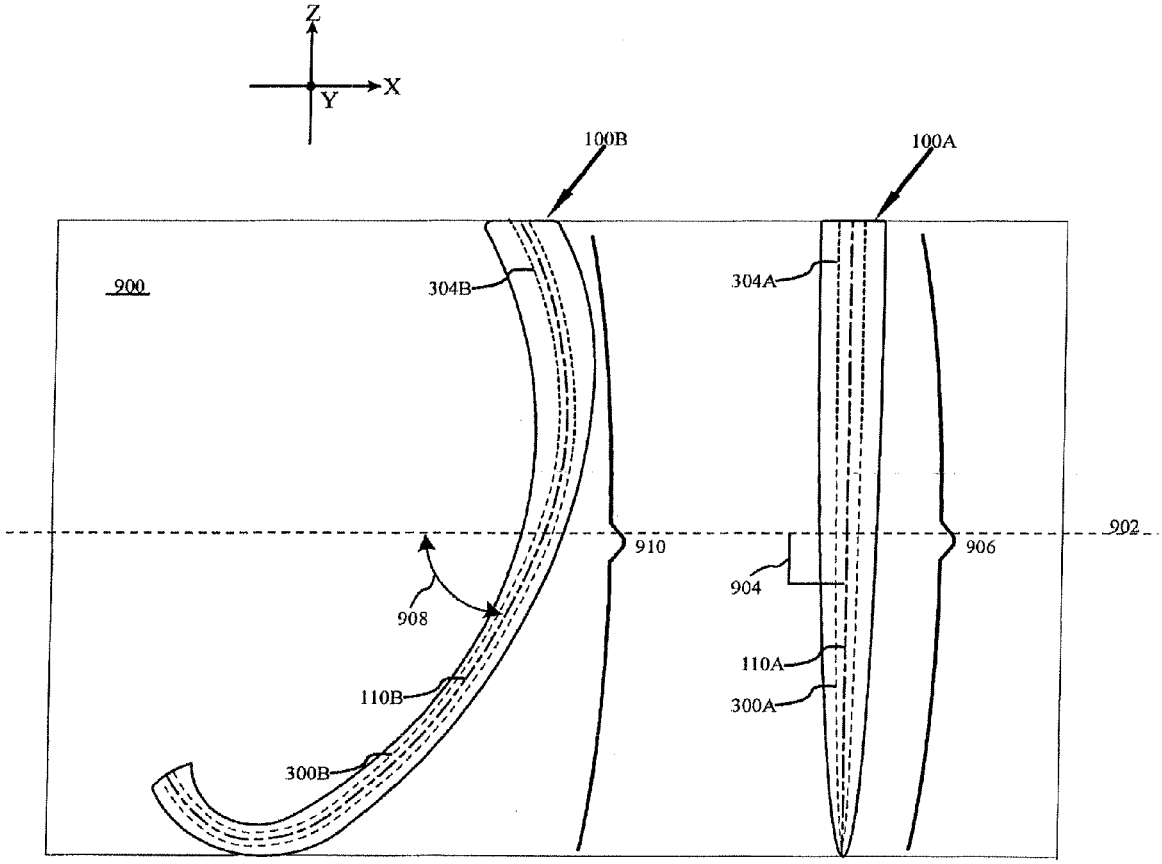
FIG. 9 is a side view illustrating an embodiment of the headband conforming to a normal section of a cylinder and an embodiment of the headband conforming to a non-normal section of a cylinder.

FIG. 9 illustrates alternative embodiments of headband 100 projected against the ZX-plane. As shown in FIG. 9, in at least one embodiment headband 100A is provided in an initial state wherein the curvilinear body 102 conforms to a section of a cylinder 900 wherein the longitudinal centerline 110A follows a path that is substantially normal (see angle 904) to the central axis 902 of the cylinder 900. This embodiment is considered as having a traditional profile 906.

To the left of the traditional profile 906 is an alternative embodiment for the headband 100B. This alternative embodiment is provided in an initial state wherein the curvilinear body 102 conforms to a section of cylinder wherein the longitudinal centerline 110B follows a path that is not normal (e.g., acute, see angle 908) to the central axis 902 of the cylinder 900. With respect to the illustration, it is also apparent that in at least one embodiment, the relative angle as between the longitudinal centerline 110B and the central axis 902 of the cylinder 900 varies from point to point. This embodiment is described as having a sweeped profile 910.

Figure 10:
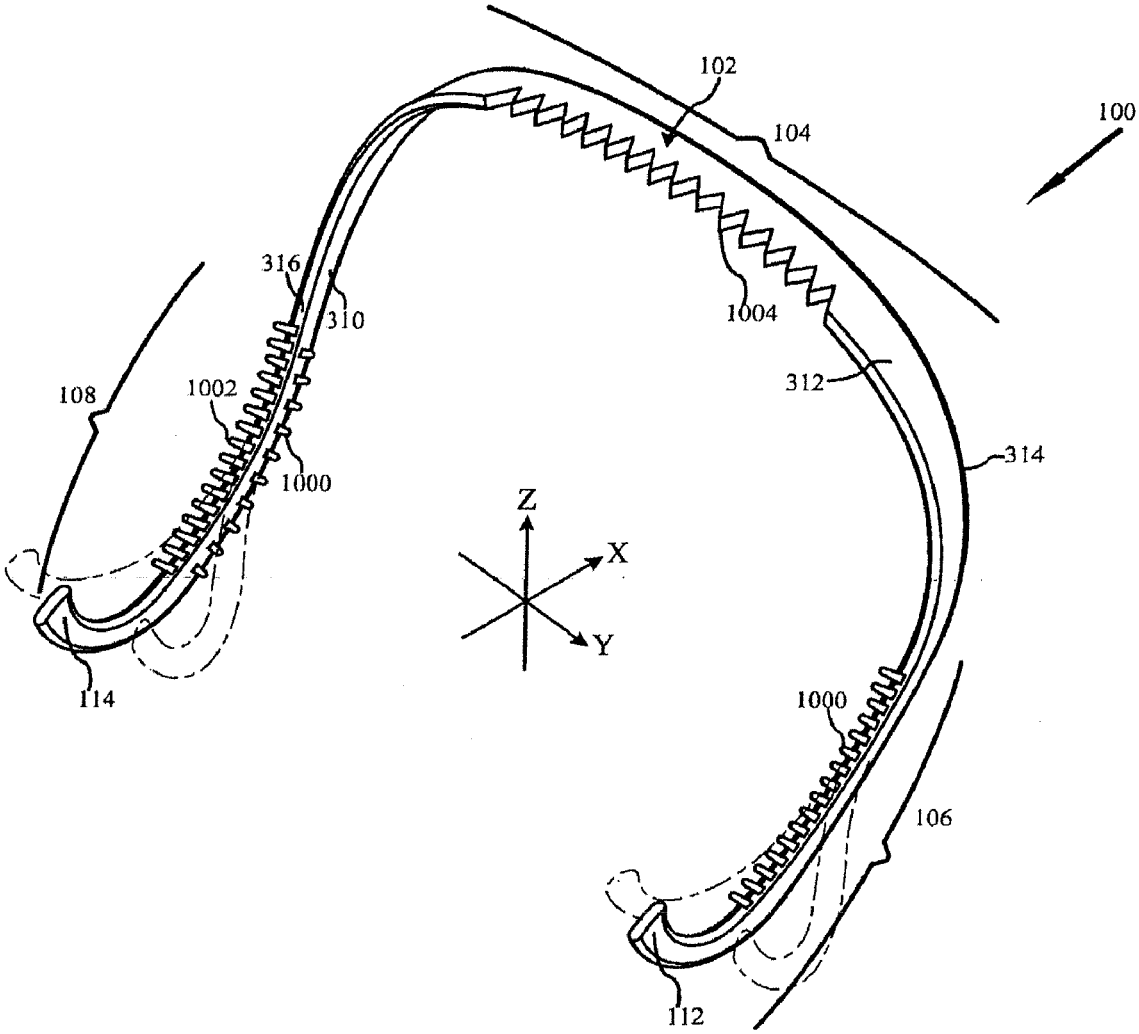
FIG. 10 is a perspective view of the headband in FIG. 1 further illustrating raised nubs along at least a portion of the first surface and trailing edge as may be employed in certain embodiments.

FIG. 10 is a perspective view of headband illustrating further alternative embodiment options. As shown, the headband 100 may have a plurality of raised nubs 1000 or teeth disposed upon the first surface 310. In at least one embodiment the raised nubs 1000 are disposed substantially about the first surface 310, though as shown they may also be disposed in one or more specific locations.

In addition, a plurality of raised nubs 1002 or teeth disposed upon the trailing edge 316. Again, these nubs 1002 may be disposed along substantially all of the trailing edge 316 or located in one or more specific locations. Although raised nubs 1000 and 1002 are shown as rod-like structures for ease of illustration and discussion, it is understood and appreciated that the raised nubs may be ridges as well as provided in varying three dimensional geometrical forms.

Further, the trailing edge 316 may itself be at least partially geometrically patterned such as that demonstrated by the tooth pattern 1004. In at least one embodiment, the raised nubs 1000, 1002 are formed of the same flexible material forming the curvilinear body 102 of headband 100. In an alternative embodiment, the raised nubs 1000, 1002 may be formed of a separate, hair tacky material that is integrated into the curvilinear body 102 of headband 100. Moreover, in a specific embodiment, the curvilinear body 102 of headband 100 is formed from nylon 6.6 with a TPE overmold in the areas proximate to raised nubs 1000, 1002.

In yet another embodiment, the raised nubs may be coated with a hair tacky material, such as TPE. It is understood and appreciated that the overmolding or coating is performed so as to avoid the generation of a hair catching edge or seam between the hair tacky material and the underlying material forming the curvilinear body 102 of headband 100.

Changes may be made in the above methods, systems, processes and structures without departing from the scope hereof, It should thus be noted that the matter contained in the above description and/or shown in the accompanying drawings should be interpreted as illustrative and not in a limiting sense. The following claims are intended to cover all generic and specific features described herein, as well as all statements of the scope of the present method, system and structure, which, as a matter of language, might be said to fall therebetween.

What is claimed is:

1. A headband, comprising:

a seamless curvilinear body structured and arranged to constrain a wearer's hair, the curvilinear body having:

a resilient arcuate midsection having a first end, a second end, and a longitudinal axis therebetween, the midsection having no pliable metal element within it;

a first end section having a first distal end and extending from the first end of the midsection;

a second end section having a second distal end and extending from the second end of the midsection;

a first pliable metal element extending within the first end section of the body from the midsection first end towards the first distal end; and a second pliable metal element extending within the second end section of the body from the midsection second end towards the second distal end, wherein the midsection is made of a resilient first material, the first end section and the second end section are made of a pliable second material, the resilient first material of the midsection and the pliable second material of the end sections are seamlessly joined together, and the first and second materials are different materials, wherein the midsection is structured and arranged to define a generalized top-of-head shape, wherein the first pliable metal element and the second pliable metal element are user-deformable to conform to the user's unique side-of-head shape so as to provide sufficient inward pressure by the first and second end sections to constrain the user's hair and insufficient pressure to cause user discomfort, and wherein the curvilinear body has a first inner surface and opposite thereto a second outer surface, the pliable end sections permitting user adjustment of the first surface to maintain a contour to the user's unique side-of-head shape.

2. The headband of claim 1, wherein the at least one flexible material is selected from the group consisting of elastic resin, plastic, natural rubber, polyurethane, and combinations thereof.

3. The headband of claim 1, wherein the curvilinear body has a first length, the midsection has a second length, and the second length is between about one-half and about one-eighth of the first length.

4. The headband of claim 1, wherein the headband conforms to a normal section of a cylinder, the longitudinal centerline being normal to a longitudinal center axis of the cylinder.

5. The headband of claim 1, wherein the headband conforms to an angled section of a cylinder, the longitudinal centerline being acutely angled with respect to a longitudinal center axis of the cylinder.

6. The headband of claim 1, wherein the first and second distal ends are swept rearward and curved upward so that when the headband is worn the first and second distal ends are positioned behind the user's ears but do not engage each other.

7. A headband, comprising:

a user-deformable metal element having a first end section, a midsection, and a second end section;

a resilient first material disposed about the midsection of the metal element that renders the midsection flexible but not deformable, the midsection structured and arranged to define a generalized top-of-head shape; and a pliable second material disposed about the first end section and the second end section and seamlessly joined to the first material, the first and second materials being different materials, the first and second materials enclosing the metal element and providing a seamless curvilinear body, wherein the end sections are structured and arranged for a user to selectively and pliably deform to conform to the user's unique side-of-head shape so as to provide sufficient pressure to constrain the user's hair and insufficient pressure to cause user discomfort.

8. The headband of claim 7, wherein the first and second pliable end sections each have a first inner surface structured and arranged to contact the user's hair, the first surfaces providing a plurality of inwardly extending raised nubs structured and arranged to engage a user's hair, and wherein the first and second pliable end sections each have a front leading edge and a rear trailing edge, at least a portion of the trailing edges including a plurality of rearwardly extending raised nubs structured and arranged to engage a user's hair.

9. The headband of claim 8, wherein the midsection has a front leading edge and a rear trailing edge, at least a portion of the trailing edge including a plurality of rearwardly extending raised nubs structured and arranged to engage a user's hair.

10. The headband of claim 7, wherein the first material is selected from a group consisting of elastic resin, plastic, natural rubber, and polyurethane, and the second material is selected from the group consisting of elastic resin, plastic, natural rubber, and polyurethane, wherein the second material selected is different than the first material selected.

11. The headband of claim 7, wherein the headband has a front leading edge and a rear trailing edge, at least a portion of the trailing edge including a plurality of rearwardly extending raised nubs structured and arranged to engage a user's hair.

12. The headband of claim 11, wherein the midsection has a first inner surface structured and arranged to contact the user's hair, the first surface including a plurality of inwardly extending raised nubs structured and arranged to engage a user's hair.

13. The headband of claim 7, wherein the curvilinear body has a longitudinal centerline extending from a first distal end of the first end section through the midsection to a second distal end of the second end section, and wherein the curvilinear body conforms to an angled section of a cylinder, the longitudinal centerline being acutely angled with respect to a longitudinal center axis of the cylinder.

14. The headband of claim 7, wherein the first and second pliable ends each have a front leading edge and a rear trailing edge, at least a portion of the trailing edges including a plurality of rearwardly extending raised nubs structured and arranged to engage a user's hair, and wherein the first and second pliable ends each have a first inner surface structured and arranged to contact the user's hair, the first surfaces including a plurality of inwardly extending raised nubs structured and arranged to engage a user's hair.

15. The headband of claim 7, wherein the first and second end sections have first and second distal ends, respectively, that are swept rearward and curved upward so that when the headband is worn the first and second distal ends are positioned behind the user's ears but do not engage each other.

16. A headband, comprising:

a seamless curvilinear body formed of a flexible material following a longitudinal centerline extending from a first distal end of a first pliable end section through a resilient arcuate midsection to a second distal end of a second pliable distal end section, the curvilinear body including an internal deformable core positioned within and over-molded with the flexible material, the flexible material selected from the group consisting of elastic resin, plastic, natural rubber, polyurethane, and combinations thereof, the deformable core made of a metal material, the resilient arcuate midsection conforming to a normal section of a cylinder and structured and arranged to define a generalized top-of-head shape, the first and second pliable end sections structured and arranged for a user to selectively deform to conform to the user's unique side-of-head shape so as to provide sufficient pressure to constrain the user's hair and insufficient pressure to cause user discomfort, the first and second distal ends swept rearward and curved upward so that when the headband is worn the first and second distal ends are positioned behind the user's ears but do not engage each other, the first and second pliable end sections each having a first inner surface structured and arranged to contact the user's hair, the first surfaces including a plurality of inwardly extending raised nubs structured and arranged to engage a user's hair, and the first and second pliable end sections each have a front leading edge and a rear trailing edge, at least a portion of the trailing edges including a plurality of rearwardly extending raised nubs structured and arranged to engage the user's hair.

17. The headband of claim 16, wherein the headband conforms to a normal section of a cylinder, the longitudinal centerline being normal to a longitudinal center axis of a cylinder.

18. The headband of claim 16, wherein the headband conforms to an angled section of a cylinder, the longitudinal centerline being acutely angled with respect to a longitudinal center axis of the cylinder.

* * * * *